US005091717A

United States Patent [19]

Carrie et al.

[11] Patent Number: 5,091,717

[45] Date of Patent: Feb. 25, 1992

[54] APPARATUS FOR SELECTING MODE OF OUTPUT IN A COMPUTER SYSTEM

[75] Inventors: Susan Carrie, Sunnyvale; Serdar Ergene, San Jose; James Gosling, Palo Alto, all of Calif.

[73] Assignee: Sun Microsystems, Inc., Mountain View, Calif.

[21] Appl. No.: 345,955

[22] Filed: May 1, 1989

[51] Int. Cl.[5] ..... G09G 1/28

[52] U.S. Cl. ..... 340/703; 340/721

[58] Field of Search ..... 340/703, 721

[56] References Cited

U.S. PATENT DOCUMENTS

| | | | |
|---|---|---|---|
| 4,550,315 | 10/1985 | Bass | 340/703 |
| 4,769,762 | 9/1988 | Tsujido | 340/721 |
| 4,772,881 | 9/1988 | Hannah | 340/703 |
| 4,862,154 | 8/1989 | Gonzalez-Lopez | 340/721 |

*Primary Examiner*—Alvin E. Oberley
*Assistant Examiner*—Matthew Luu
*Attorney, Agent, or Firm*—Blakely Sokoloff Taylor & Zafman

[57] ABSTRACT

A computer system comprising a display memory, a window indentification memory, logic circuitry for ascertaining that information to be stored at each position of the display memory is in the correct window by comparing the window number in the window identification memory with the window number of information to be sent to the display memory, and a window identification look-up table activated by window identification signals for providing an output to select the number of bits of color information to be output from the display memory to provide color information for an output device.

20 Claims, 2 Drawing Sheets

COLOR LUT SELECT
WID SELECT
31
WID LOOK-UP TABLE B 29
WID LOOK-UP TABLE A 28
WID MEMORY 18
WID REGISTER 16
WID COMPARE 20
if =
20
BIT DEPTH SELECT
DISPLAY MEMORY SELECT
WRITE ENABLE LOGIC 22
WRITE FAILED
WID ON
WID SELECT
CONTROL REGISTER 26
DISPLAY MEMORY B 14
DISPLAY MEMORY A 13
MUX 24
0 1 2 3 4 5
30
24 BIT RGB COLOR LUT 0 34
24 BIT RGB COLOR LUT N 36
COLOR INDEX LUT 0 38
COLOR INDEX LUT m 40
32
DISPLAY
CONSTANT 0s
FROM CPU

APPARATUS FOR SELECTING MODE OF OUTPUT IN A COMPUTER SYSTEM

BACKGROUND OF THE INVENTION

1. Field of the Invention

This invention relates to logic circuitry and, more particularly, to logic circuitry for a computer system which may be utilized to dynamically select among a number of particular individual display formats from a constant sized display memory.

2. History of the Prior Art

One common interface used for computer operations utilizes multiple "windows" displayed on a cathode-ray tube to represent individual computer applications. In a system using windows, more than one program at a time is placed in portions of memory which are available for instant call. The text and graphics output of each such program is made to appear on the cathode ray tube screen in a particular set of defined boundaries called a window. Each window may overlap other windows.

Window systems have several advantages. A user may switch between different activities which involve interaction with a display device without completely changing the appearance of the display. In addition, in multiprocessing of and multitasking systems, several processes can use the display to communicate information to the user.

One system utilizing windows is disclosed in U.S. patent application Ser. No. 07/254,957, *Apparatus for Rapidly Clearing the Output Display of a Computer System*, Joy et al., filed Oct. 7, 1988, and assigned to the assignee of the present invention. The system disclosed therein is especially useful for providing animated output because of its ability to rapidly switch between images presented on the output display without the necessity of clearing its display memories and other associated memories. In order to accomplish this, the system utilizes double-buffered full-screen-bitmapped display memories which may be rapidly switched to the output display.

In order to provide for windowing, this system utilizes a full-screen-bitmapped window identification memory and associated logic circuitry for determining whether the information in a particular display memory falls within the window to be displayed on the output display. The system is especially useful because it provides automatic clipping of overlapping windows.

Although such a system is very useful, a number of additional facilities would make it even more useful. For example, the preferred embodiment of the computer system above disclosed provides double-buffered display memories capable of storing twenty-four bits of RGB color information for display at each pixel of a cathode ray tube. Although double-buffered display memories are useful for the rapid switching between frames required by animated applications; such display memories are unnecessary for applications which are not used to display animated graphics. Consequently, such a system would be enhanced were it capable of selectively utilizing single- or double-buffered display memories.

Moreover, although some applications are capable of utilizing twenty-four bits of RGB color memory at each pixel position, the number of colors and hues utilized by many programs is much less. Consequently, a system which provides the ability to select the number of bits utilized for storing information to be displayed at individual pixels of the output display would make more efficient use of the hardware of the computer system and thus prove useful in a computer system.

Additionally, either of the foregoing improvements in a computer system frees memory which might advantageously be made available to enhance other operations of the computer system.

It is, therefore, an object of the present invention to provide a computer system which includes logic circuitry for use in determining whether the system will utilize single- or double-buffered display memories for a particular window.

It is another object of this invention to provide a computer system which provides for multiple uses of the display memory.

It is another object of this invention to selectively control the translation of data from display memories to the colors realized on the output display.

It is an additional object of the present invention to utilize pre-existing memory in a computer system to provide for the rapid selection of colors and hues to be utilized by different programs on an output display of that system.

SUMMARY OF THE INVENTION

These and other objects and features are accomplished by a computer system which utilizes at least one full screen bitmapped display memory, a second full screen bitmapped memory for storing information regarding the output to be provided by a particular application, and a first look-up table activated by signals related to a particular application for varying the appearance of the output on the output device. The look-up table provides signals for selecting the particular display memory to be used when double buffering the number and format of the bits to be used from the stored color information, and the particular colors to be provided at the output device.

These and other features and advantages of the present invention will become apparent to those skilled in the art upon reading the following detailed description in conjunction with the several figures of the drawings in which like designations have been used for identical components throughout.

PRIOR ART

The system disclosed in the application referred to above uses two full-screen-bitmapped memories to accomplish rapid switching between frames on the output display.

The system uses a full-screen-bitmapped window identification memory to block out an area for each window. Then, when information is written to the display memories, a comparison is made with the area blocked out for the particular window to see if the information is in the window. If the incoming information contains the window number of the position to which it is to be written, it is written to the display memory; if not in that window, it is ignored.

Figure 1:
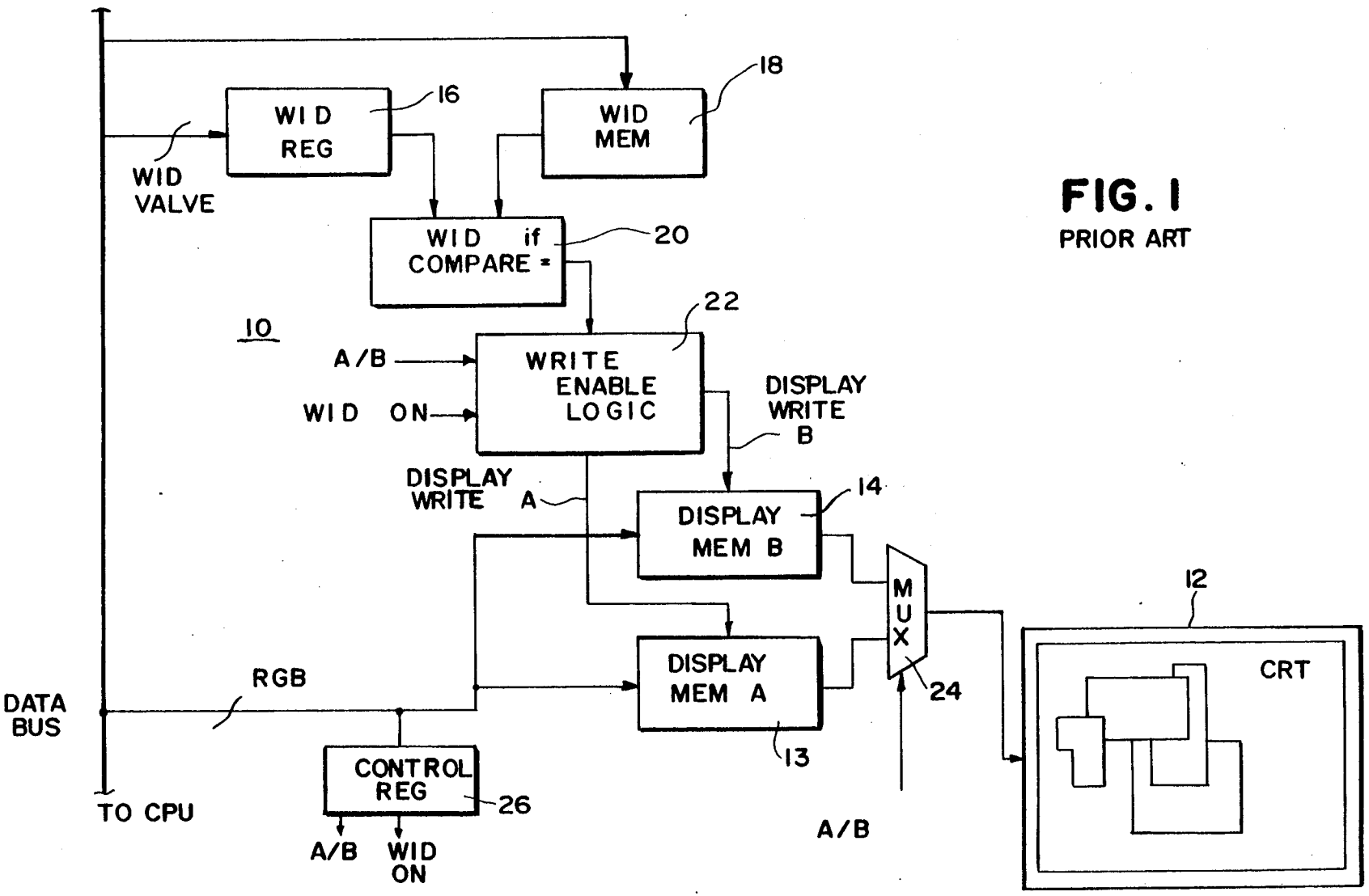
FIG. 1 PRIOR ART
FIG. 1 is a block diagram illustrative of a computer system utilized in the prior art.

More particularly, FIG. 1 illustrates a window identification output system 10 which may be utilized to provide multiple windows on a cathode ray tube 12. System 10 includes a pair of double-buffered display memories (A) 13 and (B) 14, each of which is a full screen bitmapped memory. In a preferred embodiment each display memory may include twenty-four bits of storage for storing color information at each position representing a pixel on the cathode ray tube 12. The system 10 also includes a window identification (WID) register 16 which in a preferred embodiment stores four bits of information and a window identification (WID) memory 18 which in the preferred embodiment is a full screen bitmapped memory which stores four bits of information for each pixel of the display. A window identification (WID) comparator 20 compares output signals from the WID register 16 and the WID memory 18 for operating a write enable circuit 22. The system 10 also includes a multiplexor 24 and a control register 26 for selectively enabling each of the display memories A and B and enabling the WID function.

In operation, the particular areas to be utilized for individual windows are first selected by values provided from the CPU. These values include both a pixel address and a window identification number for each pixel to be included in each window. The window identification number is written to each corresponding position of the particular window in the window identification memory 18. When a window is written to the window identification memory, each position defining that window within the WID memory stores stores the window identification number for that window. When another window which lies in front of the first window is written to the window identification memory, the window number for that second window is stored at each position representing the second window so that portions of the second window which overlay the first are written on top of the overlapping positions of the first and, therefore, automatically cover and clip the first window. After all of the windows desired have been written, the window identification memory 18 has stored indications of individual windows for areas such as are shown on the display of the cathode ray tube 12 in FIG. 1.

When it is desired to write information to a display memory for a particular window (the system for windowing may be used with single display memories as well as double-buffered systems), the information is written into the display memory from the CPU through the data bus. This information includes a pixel address, an RGB color value, and a window identification number. The window identification number is stored in the window identification register 16 and compared to the window identification number stored at the position representing that pixel in the window identification memory 18. Typically, the WID number stored in the WID Register is written once and used for many pixels and graphics objects. If the window identification number stored in the window identification memory 18 is the same as that in the window identification register 16, the comparator circuit 20 causes the write enable logic 22 to allow the RGB color information to be written to the position representing the addressed pixel of the selected display memory 13 or 14. If the comparator circuitry determines that the window identification number is not the same as the number stored at that pixel in the window identification memory, then the RGB color information is not stored in the display memory. Consequently, only at those addressed positions of the selected display memory which are within each particular window will the color information for that window be written. The color information written to the display memory is ultimately transferred from the particular display memory via the multiplexor 24 to the cathode ray tube 12 shown in FIG. 1.

A number of advantages are realized by the use of the window identification system just described. For example, without more, the window identification system provides that the information in a particular window is written to the correct area of the display and that portions of any particular window which lie behind other windows are appropriately clipped. Moreover, since the window identification memory is a full screen bitmapped memory, the windows may be of any shape rather than simply rectangular windows as in the usual case.

DETAILED DESCRIPTION OF THE INVENTION

Figure 2:
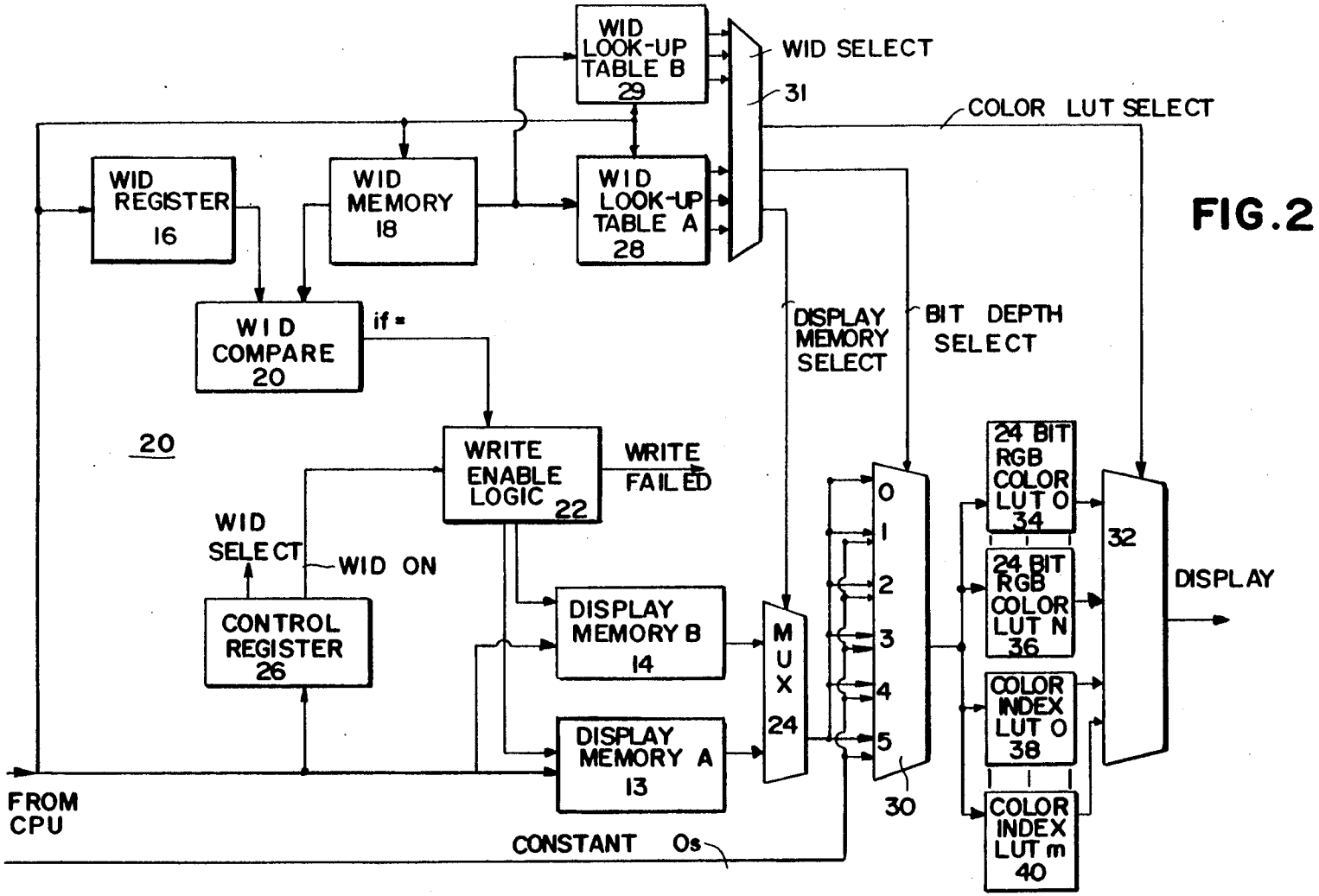
FIG. 2 is a block diagram illustrating an improved computer system in accordance with the present invention.

Referring now to FIG. 2 there is shown an improved computer output system 20 based on the system 10 disclosed in FIG. 1. The system 20 includes double-buffered display memories 13 and 14 (also designated A and B) which in the preferred embodiment may store twenty-four bits of information at each position representing a pixel on the output display. These double-buffered memories 13 and 14 are especially useful in systems which provide animated output to a display. The system 20 described in the present invention will, however, operate as well with a single display memory.

The system 20 also includes a window identification (WID) register 16, a window identification (WID) memory 18, and a window identification (WID) comparator 20 which operate in the manner described above with respect to FIG. 1 to control the writing of information to an appropriate window of a cathode ray tube or other output device. As with the system 10 described in FIG. 1, the output of the window identification comparator 20 is furnished to a write enable circuit 22 which provides signals for enabling either of the display memories 13 or 14 depending on the information provided from a CPU (not shown in FIG. 2). A control register 26, is also included in the system 20 for actuating the write enable logic 22.

The portions of the system 20 described to this point operate in essentially the same manner as does the circuitry of the system 10 described above to provide information from particular programs to particular windows on an output display.

The system 20, however, includes in addition, a number of circuits which allow it to perform in a substantially enhanced manner. First there is a WRITE FAILED signal provided from WRITE Enable Logic 22 which indicates if any of the pixels have not been written because the WID comparison failed. Such a signal is useful for informing the software that a portion of a window has been clipped so that the software may later deal with the clipped portion. Such a signal may be stored by storage means well known to art and later utilized.

The system 20 also includes a double buffered window identification (WID) look-up tables 28 and 29 which are connected to receive signals from the window identification memory 18 and the CPU. The signals received from the window identification memory 18 are the four bit signals stored at each position representing each pixel of the display. Since four bit positions are utilized, each such signal designates one of a possible sixteen individual windows or window types for display at the output.

A WID select bit from control register 26 is used to select either WID look up table (A) 28 or WID look up table (B) 29 at any instant of time using multiplexor 31. The double buffering of WID look up tables allows the host to change the contents of one table while the other table is used for display output. Once the window display attributes have been changed in the background WID look up table, the CPU changes the WID select bit during the display vertical blanking period. This provides the ability to change window display attributes without disrupting the display.

Each of the window identification (WID) look-up tables 28 and 29 provides three outputs. The first output is directed by the multiplexor 31 to the multiplexor 24 for controlling the selection of either display memory (A) 13 or display memory (B) 14. The second output is directed by the multiplexor 31 to a multiplexor 30 which is utilized to select among a number of different color depths such as twenty-four bit color information, twelve bit color information, or eight bit color information. This same selection at multiplexor 30 can also be interpreted as selecting a single buffer when the depth is 8, 12, 24 bits between double buffers when the depth is 8 or 12 bits, or between triple buffers when the depth is 8 bits. The third output from the window identification look-up tables 28 and 29 is directed, by the multiplexor 31 to a multiplexor 32 which selects among a number of different color look-up tables for providing color signals to the output display.

The display refresh operation occurs when the read out of the contents of the display memory is sent to the CRT output for display. The WID memory contents are read out just like the display memory contents are read out during the display refresh operation.

As explained above, in the preferred embodiment of the invention, the window identification memory 18 stores four bits of information at each position to designate the window number of a pixel on the output display. This four bits of information allows sixteen individual windows or window types to be selected. Each of those signals is furnished to the WID look-up tables 28 or 29 and causes a particular set of outputs to be directed to the three multiplexors 24, 30 and 32 to control the appearance of the display for that particular window. For example, a first window to appear on a display might select the display memory 13 for the storage of color information. This information is selected by that window number in the look-up tables 28 or 29 and causes a signal to be directed to the multiplexor 24 to select the output from the display memory 13. Alternatively, another window number might select display memory 14 and direct a signal to the multiplexor 24 to select that display memory 14.

In the preferred embodiment of the invention as explained with respect to FIG. 1, a pair of display memories 13 and 14 are utilized in order to provide double buffered output for rapid switching to the output display. This is useful in an arrangement which is utilized for animation purposes. In this preferred embodiment of the invention, each of the display memories 13 and 14 provides twenty-four bits of RGB color information at each position representing a pixel on the output display. If twenty-four bits of color information are utilized, eight of these bits provide red color information, eight of the bits provide green color information, and eight of the bits provide blue color information. These are furnished by the multiplexor 24 to a number of input terminals of the multiplexor 30. If the color depth of the window is twenty-four bits, the signal is furnished at all of the inputs to the multiplexor 30, The data at the input labelled zero is selected by the depth select output of the WID look-up tables 28 or 29 and transferred by the output of the multiplexor 30 to a number of color look-up tables 34, 36, 38, and 40.

For many applications, however, twenty-four bits of color information are not utilized. For example, some applications may utilize only twelve bits of RGB color information while other applications utilize only eight bits of color information. This fact allows a single display memory to be utilized for either double or triple buffered output.

For example, if only twelve bits of RGB color information are utilized by a particular application, this information when stored in one the display memories 13 or 14 leaves an additional twelve bits of storage at each position which may be utilized for a second frame of the same application. Presuming for example that twelve bits of RGB color information are stored in the twelve most significant bits of the display memory 14, an additional twelve bits may be stored in the twelve least significant bits at each position of the display memory 14. The window look-up table 28 then provides indications by the depth selector input to the multiplexor 30 to first select the twelve most significant bits as a first frame and then to select the twelve least significant bits of the information at each position as a second frame. These inputs to the multiplexor 30 are furnished at the terminals labelled as 1 and 2. Consequently, first and second frames of a particular application may be stored in the same display memory 13 or 14, selected one after another by the depth selection output from the WID look-up table 28, and furnished to the multiplexor 30 for the particular window.

With each of the twelve bits of RGB color information at the input terminals of the multiplexor 30, there is a second line provided to each of the input positions 1 and 2, a 12 bit pattern, in the preferred embodiment, a constant string of twelve zeros, to complete the necessary twenty-four bits of color information which is necessary for the color look-up tables 34, 36, 38, and 40.

The consequence of this ability of the system 20 is that a single display memory 13 or 14 may be utilized as a double buffered display memory by using the first twelve bits at each position to represent a first frame of color information and the second twelve bits at each position to represent a second frame of color information. Consequently, even though only a single display memory 13 or 14 is provided for the system 20 in a particular embodiment double buffering may still be accomplished.

In like manner, certain applications utilized by the system 20 may be adapted to perform with only eight bits of color information. In such a case, each position of a display memory 13 or 14 may be utilized to store three distinct frames of color information which may be switched by means of the depth selector output of the WID look-up tables 28 or 29 to the output of the multiplexor 30. In essence, when only eight bits of color information are utilized by the application in the particular window, either of the display memories 13 or 14 is by itself capable of providing triple buffered output. The inputs provided to the multiplexor 30 at positions 3, 4, and 5 then each carry eight bits of color information. Along with each eight bits of information, there is a sixteen bit pattern provided, in the preferred embodiment, a sixteen bit constant of zeros to fill the required twenty-four bits for transfer to the color look-up tables 34, 36, 38, and 40 by the output of the multiplexor 30.

In the system 20 shown in FIG. 2, the eight bits of input selected at the input position 3 are the eight most significant bits, the eight bits of input selected at the position 5 are the eight least significant bits, and the eight bits of information at position 4 are the intervening bits.

To recapitulate, the 0 input to the multiplexor 30 provides twenty-four full bits of single buffered color information. The 1 and 2 inputs to the multiplexor 30 each provide twelve bits of double-buffered RGB color information. The 3, 4, and 5 inputs each provide eight bits of triple-buffered color information. It is, of course, not necessary that the display memories 13 and 14 be utilized to provide double-buffering when utilizing twelve bits of color information or triple-buffering when utilizing eight bits of color information. It is quite possible that any particular application might utilize eight or twelve bits of color information yet provide only single buffered output. If this is the case, the window look up table 28 or 29 selects the individual input terminal to be utilized by the multiplexor 30 to provide output to the color look-up tables.

Each of the outputs of the multiplexor 30 is handled differently by the color look-up tables. In a complete twenty-four bit RGB color signal, eight of these bits are utilized to indicate red, eight are utilized to indicate green, and eight are utilized to indicate blue. These are transferred by the output of the multiplexor 30 to one of 0–N color look-up tables (indicated in FIG. 2 as tables 34–36), a plurality of color look-up tables provided by the system 20 for handling twenty-four bits of RGB information. A particular window number provided to the WID look-up table 28 or 29, for example, will select a particular one of the twenty-four bit RGB color look-up tables to provide color output to the display.

These same twenty-four bit color look-up tables are utilized when only twelve bits of color information are available and the remaining bit positions are filled with zeros. In such a case, a particular color look-up table is provided with the necessary values for each of the possible color signals available at the output of the multiplexor 30, and the window look-up table 28 or 29 provides via the multiplexor 31 the appropriate signal on the color look-up table select line to the multiplexor 32 to select output from this particular color look-up table.

In a like manner, when a particular application utilizes only eight or twelve bits of color information and the remaining bits are filled with zeroes, that information is provided at the output of the multiplexor 30 and furnished to each of the color look-up tables. The selection of the particular color look-up table to be utilized is again made by the window identification look-up table 28 or 29 on the color look-up table select line controlling the multiplexor 32. The color look-up tables which operate with eight or twelve bits of color information are those tables indicated as 38–40 which are further identified as color index look-up tables zero through m in FIG. 2. In the case of eight bits of color information, two hundred fifty-six possible output combinations are provided by each of the color index look-up tables zero through m. In the case of the twelve bits of color information, four thousand ninety-six possible output combinations are provided by each of the color index look up tables zero through m. The particular table selected depends on the particular window in operation, the window number of which causes the WID look-up table 28 or 29 to provide the appropriate signal on the color LUT select line to control the multiplexor 32.

A special advantage of the present invention is that the window identification look-up table 28 may be simply reprogrammed by signals from the CPU to provide what amounts to, essentially, a new set of selection parameters for the multiplexors 24, 30 and 32. By changing only a single bit within the window identification look-up table 28, the CPU may provide for entirely different selections of the display memories 13 and 14, of the depth of color information provided by the multiplexor 30, and of the selection provided of color look-up tables by the multiplexor 32.

This programmability allows a significant number of variations with the system 20. For example, if a first application utilizes twenty-four bits of RGB color, then the color look-up table zero (indicated as 34 in FIG. 2) may be utilized and selected by the color look-up table select output of the window identification look-up table 28 by means of multiplexor 32. If, while operating with that particular application, it is desired to change the colors available, then a reprogramming of a single bit of the color look-up table 28 may cause a select signal to be provided to the multiplexor 32 to select a different one of the twenty-four bit RGB color look-up tables.

Moreover, an additional advantage of the present invention is that each of the color look-up tables are programmable and thus may be varied by signals from the CPU to provide additional color information beyond that available in a fixed look-up table. For example, the CPU may provide signals to reprogram a particular twenty-four bit RGB color look-up table one while the twenty-four bit RGB color look-up table zero is being utilized so that the color look-up table one may immediately be chosen by means of the multiplexor 32 upon completion of the present operation. Obviously, the same facility may be utilized to reprogram individual ones of the color index look-up tables zero through m (38–40). This programmability provides for essentially an infinite variation in colors which may be made available to any particular application. Such a provision is a substantial improvement over fixed color look-up tables provided by the prior art.

Although the present invention has been described in terms of the preferred embodiment, it will be appreciated that various modifications and alterations might be made by the skilled in the art without departing from the spirit and scope of the invention. The invention should therefore be measured in terms of claims which follow:

We claim:

1. A window display system comprising a display device and a display memory for displaying pixel data of an input image in a window on a display device, said pixel data being stored in the display memory and output from the display memory for generation of the image on the display device, each of said pixel data comprising color information and is identified by a window ID (WID) to indicate the window the image is to be displayed in, said system comprising:

a WID register for storing the WID for the pixel data of the input image to be displayed;

a WID memory for storing the WID for each pixel stored in a display memory;

a WID comparison circuit coupled to the WID register and WID memory to receive as input the WID for a pixel of the input image to be displayed at a particular pixel address on the display and the WID of the pixel at the same pixel address in display memory, said WID comparison circuit issuing a signal indicating whether the pixel of the input image is to be written to the display memory;

write enable logic for controlling the pixel data to be written to the display memory whereby the pixel data is written to the display memory when the WID comparison circuit issues the signal indicating that the pixel data is to be written to the display memory;

a WID lookup table coupled to receive the WID for a pixel data, said lookup table storing the number of bits of color information utilized for each window, said WID lookup table, upon receipt of a WID for a pixel, issuing a bit depth select signal identifying the number of bits of color information comprising the pixel data;

a first selection means coupled to the WID lookup table for receiving the bit depth select signal and coupled to the display memory for receiving the color information of the pixel data, said first selection means receiving the color information in a plurality of formats according to the number of bits of color information, each of said formats being received at a predetermined input port to the first selection means, said first selection means selecting the color information received at the input port identified by the bit depth select signal to be output for display;

whereby an image is displayed in a window on a display device.

2. The window display system as set forth in claim 1, said system further comprising:

a plurality of color lookup tables each color lookup table identifying a color of a pixel to be displayed on the display device which corresponds to the color information of the pixel data, said WID lookup table further storing for each window a color lookup table ID (CLUT ID) identifying a color lookup tables to be used to display the window, said WID lookup table issuing a CLUT select signal identifying the color lookup table to be used, a second selection means coupled to the WID lookup table for receiving the CLUT select signal and to the first selection means for receiving color information, said second selection means selecting the color lookup table to receive the color information to identify the color of the pixel to be generated on the display.

3. The window display system as set forth in claim 1, said system further comprising:

a plurality of display memories;

said WID lookup table further storing for each window a display memory ID identifying the display memory to be used to display the window, said WID lookup table issuing a display memory select signal identifying the display memory to be used;

a third selection means coupled to the WID lookup table to receive the display memory select signal and coupled between the display memories and the first selection means, said third selection means selecting the display memory to receive the pixel data to be output to the first selection means.

4. The window display system as set forth in claim 1, said system further comprising:

a plurality of WID lookup tables;

a WID lookup table select means coupled to the WID lookup tables for selecting a WID lookup table to be utilized.

5. The window display system as set forth in claim 4, wherein said WID lookup tables are programmable whereby a first WID lookup table is selected while a second lookup table is programmed.

6. A window display system comprising a display device and a plurality of display memories for displaying pixel data of an input image in a window on a display device, said pixel data being stored in the display memory and output from the display memory for generation of the image on the display device, each of said pixel data comprising color information and is identified by a window ID (WID) to indicate the window the image is to be displayed in, said system comprising:

a WID register for storing the WID for the pixel data of the input image to be displayed;

a WID memory for storing the WID for each pixel stored in a display memory;

a WID comparison cirucit coupled to the WID register and WID memory to receive as input the WID for a pixel of the input image to be displayed at a particular pixel address on the display and the WID of the pixel at the same pixel address in a display memory, said WID comparison circuit issuing a signal indicating whether the pixel of the input image is to be written to the display memory;

write enable logic for controlling the pixel data to be written to the display memory whereby the pixel data is written to the display memory when the WID comparison circuit issues the signal indicating that the pixel data is to be written to the display memory;

a plurality of color lookup tables each color lookup table identifying a color of a pixel to be displayed on the display device which corresponds to the color information of the pixel data, a WID lookup table coupled to receive the WID for a pixel data, said lookup table storing the number of bits of color information utilized for each window, a display memory ID identifying the display memory to be used to display the window, said WID lookup table issuing a display memory select signal identifying the display memory to be used, a color lookup table ID (CLUT ID) identifying a color lookup table to be used to display the window, said WID lookup table, upon receipt of a WID for a pixel, issuing a bit depth select signal identifying the number of bits of color information comprising the pixel data, a CLUT select signal identifying the color lookup table to be used, and a display memory select signal identifying the display memory to be used;

a first selection means coupled to the WID lookup table for receiving the bit depth select signal and coupled to the display memory for receiving the color information of the pixel data, said first selection means receiving the color information in a plurality of formats according to the number of bits of color information, each of said formats being received at a predetermined input port to the first selection means, said first selection means selecting the color information received at the input port identified by the bit depth select signal to be output for display;

a second selection means coupled to the WID lookup table for receiving the CLUT select signal and to the first selection means for receiving color information, said second selection means selecting the color lookup table to receive the color information to identify the color of the pixel to be generated on the display;

a third selection means coupled to the WID lookup table to receive the display memory select signal and coupled between the display memories and the first selection means, said third selection means selecting the display memory to receive the pixel data to be output to the first selection means;

whereby an image is displayed in a window on a display device.

7. The window display systems as set forth in claim 6, further comprising:

a plurality of WID lookup tables;

a WID lookup table select means coupled to the WID lookup tables for selecting a WID lookup table to be utilized.

8. The window display system as set forth in claim 6, wherein said display memory stores is enabled to store 24 bits of color information per pixel.

9. The window display system as set forth in claim 8, wherein the color information per pixel is 24 bits in length and the color information for each pixel is input to a first input port of the first selection means, said bit depth select signal identifying the first input port as receiving color information to be output for display.

10. The window display system as set forth in claim 8, wherein the color information per pixel is 12 bits in length and the color information is input to a second input port of the first selection means, said bit depth select signal identifying the second input port as receiving color information to be output for display.

11. The window display system as set forth in claim 10, further comprising a zero generator means, said zero generator means generating a sequence of 12 zero values for input to a third input port of the first selection means, wherein said bit depth select signal identifies the second and third input port as receiving color information to be output for display.

12. The window display system as set forth in claim 10, wherein the second input port receives the lower 12 bits of 24 bits output for display and the third input port receives the higher 12 bits of the 24 bits output for display.

13. The window display system as set forth in claim 12, wherein the color information for each pixel for a first frame of pixel data to be displayed is stored in the lower 12 bits of the display memory and the color information for each pixel for a second frame of pixel data to be displayed is stored in the higher 12 bits of the display memory, said bit depth select signal identifying the second input port to be output to display the first frame of pixel data and the third input port to be output to display the second frame of pixel data.

14. The window display system as set forth in claim 11, wherein, the color information for each pixel for a first frame of pixel data to be displayed is stored in the lower 12 bits of the display memory and the color information for each pixel for a second frame of pixel data to be displayed is stored in the higher 12 bits of the display memory, said zero generator means generating a sequence of 12 zero values for input to the third input port of the first selection means for display of the first frame of pixel data and generating a sequence of 12 zero values for input to the third input port of the first selection means for display of the second frame of pixel data, the second input port receiving the lower 12 bits of 24 bits output for display to display a first frame of pixel data and the third input port receiving the higher 12 bits of the 24 bits output for display to display a second frame of pixel data, said bit depth select signal identifying the second and third input ports to be output for display of the first frame of pixel data and second frame of pixel data, whereby when the first frame of pixel data is to be output for display, said first selection means outputs the lower 12 bits received at the second input port and a string of zero values received at the third input port, and when the second frame of pixel data is to be output for display, said first selection means outputs the higher 12 bits received at the third input port and a string of zero values received at the second input port.

15. The window display system as set forth in claim 8, wherein the color information per pixel is 8 bits in length and the color information is input to a fourth input port of the first selection means, said bit depth select signal identifying the fourth input port as receiving color information to be output for display.

16. The window display system as set forth in claim 15, further comprising a zero generator means, said zero generator means generating a sequence of 8 zero values for input to a fifth input port and sixth input port of the first selection means, wherein said bit depth select signal identifies the fourth, fifth and sixth input port as receiving color information to be output for display.

17. The window display system as set forth in claim 15, wherein the fourth input port receives the lower 8 bits of 24 bits output for display, the fifth input port receives the higher 8 bits of the 24 bits output for display, and the sixth input port receives the middle 8 bits of the 24 bits output for display.

18. The window display system as set forth in claim 17, wherein the color information for each pixel for a first frame of pixel data to be displayed is stored in the lower 8 bits of the display memory, the color information for each pixel for a second frame of pixel data to be displayed is stored in the higher 8 bits of the display memory, and the color information for each pixel for a third frame of pixel data to be displayed is stored in the middle 8 bits of the display memory, said bit depth select signal identifying the fourth input port to be output to display the first frame of pixel data, the fifth input port to be output to display the second frame of pixel data, and the sixth input port to be output to display the third frame of pixel data.

19. The window display system as set forth in claim 16, wherein, the color information for each pixel for a first frame of pixel data to be displayed is stored in the lower 8 bits of the display memory, the color information for each pixel for a second frame of pixel data to be displayed is stored in the higher 8 bits of the display memory, and the color information for each pixel for a third frame of pixel data to be displayed is stored in the middle 8 bits of the display memory, said zero generator means generating a sequence of 8 zero values for input to the fifth input port and to the sixth input port of the first selection means for display of the first frame of pixel data, generating a sequence of 8 zero values for input to the fourth input port and fifth input port of the first selection means for display of the second frame of pixel data, and generating a sequence of 8 zero values for input to the fourth input port and sixth input port of the first selection means for display of the third frame of pixel data, the fourth input port receiving the lower 8 bits of 24 bits output for display to display a first frame of pixel data, the sixth input port receiving the higher 8 bits of the 24 bits output for display to display a second frame of pixel data, and the fifth input port receiving the middle 8 bits of the 24 bits output for display to display a third frame of pixel data, said bit depth select signal identifying the fourth, fifth and sixth input ports to be output for display of the first frame of pixel data and second frame of pixel data, whereby when the first frame of pixel data is to be output for display, said first selection means outputs the lower 8 bits received at the fourth input port and a 2 8-bit strings of zero values received at the fifth input port and sixth input port, when the second frame of pixel data is to be output for display, said first selection means outputs the higher 8 bits received at the sixth input port and a 2 8-bit strings of zero values received at the fourth input port and fifth input port, and when the third frame of pixel data is to be output for display, said first selection means outputs the middle 8 bits received at the third input port and 2 8-bit strings of zero values received at the fourth input port and sixth input port.

20. The window display system as set forth in claim 6, wherein predetermined color lookup tables are to be utilized with predetermined formats of color information, said CLUT select signal generated to select a color lookup table to be utilized with the format of color information.

* * * * *